United States Patent [19]

Stedman

[11] 3,985,247

[45] Oct. 12, 1976

[54] MID-CARRY LOADER

[75] Inventor: Robert N. Stedman, Chillicothe, Ill.

[73] Assignee: Caterpillar Tractor Co., Peoria, Ill.

[22] Filed: Mar. 31, 1975

[21] Appl. No.: 563,865

[52] U.S. Cl. ..... 214/140

[51] Int. Cl.[2] ..... E02F 3/00

[58] Field of Search ..... 214/140, 138 R, 765, 214/770, 779, 77 R, 78

[56] References Cited

UNITED STATES PATENTS

| | | | |
|---|---|---|---|
| 2,571,751 | 10/1951 | Orlowsky | 214/78 |
| 3,279,630 | 10/1966 | Trieschmann | 214/78 |
| 3,339,769 | 9/1967 | Conrad | 214/770 |

FOREIGN PATENTS OR APPLICATIONS

| | | | |
|---|---|---|---|
| 1,431,422 | 9/1969 | Germany | 214/78 |

*Primary Examiner*—L. J. Paperner
*Assistant Examiner*—Ross Weaver
*Attorney, Agent, or Firm*—Phillips, Moore, Weissenberger, Lempio & Strabala

[57] ABSTRACT

A wheeled vehicle includes arms and links associated with a bucket, the arms being pivotable about a pivot axis which is substantially aligned with the axis of rotation of the front wheels of the vehicle. The arms and links may be appropriately placed so that the bucket is in a position forward of the wheels, and the arms and links may be further appropriately pivoted to move the bucket to a position generally rearwardly of the front wheels of the vehicle.

13 Claims, 3 Drawing Figures

MID-CARRY LOADER

BACKGROUND OF THE INVENTION

This invention relates to loader vehicles, and more particularly, to such a vehicle which includes a bucket which may be moved to a position generally rearward of the front wheels thereof.

Manufacturers of material handling vehicles often modify their products to obtain improved loading and/or hauling capability which might be needed to fit a customer's specific application. Standard wheel loaders may have their bucket linkage altered both to afford increased break-out force and higher reach. Other loaders have been provided with auxiliary rearmounted bucket, as disclosed in U.S. Pat. No. 3,526,329 to Anderson et al., assigned to the Assignee of this invention, to provide increased hauling capacity.

In the past, it has been recognized that balanced placement of a load carried by a bucket of a vehicle, during the actual transport of such load by the vehicle, is highly desirable. That is, it has been found that it is highly advantageous to position the load carried by the bucket for actual transport thereof somewhat inwardly of the vehicle relative to the position of such bucket during loading thereof.

U.S. Pat. Nos. 2,328,715, to Drott; 3,079,020, to Gustine; 3,125,234, to Gustine; and 3,221,909 to Magnuson disclose a material handling vehicle which includes an implement which is loaded in a position relatively outward of a pair of wheels of the vehicle, and which is subsequently moved to a position inward of such a loading position relative to the vehicle for carrying of the load. However, in each of these patents, it is to be noted that the implement when being carried is in a position substantially above the axis of rotation of a pair of wheels. While such placement of a load aids in the overall balancing of the vehicle, it is to be understood that it would be even more desirable to place such loaded implement even further inward of such wheels, i.e., between the rotational axes of the forward and rearward wheels of the vehicle.

A similar analysis applies to U.S. Pat. No. 2,978,124 to Bernotas, and U.S. Pat. No. 3,059,792 to Bernotas. That is, the loaded implement when being carried by the vehicle is positioned substantially directly above the axis of rotation of the forward pair of wheels of the vehicle.

In U.S. Pat. No. 3,703,973 to Nilsson, a bucket is shown as being disposed rearwardly of the front wheels, and forwardly of the rear wheels, and the load in such bucket may be transported with the bucket in such position. It is to be noted, however, that the arms associating the bucket with the vehicle are pivotally mounted to the vehicle at approximately the mid-point thereof. While the placement of such arms may be appropriate in such U.S. Pat. No. 3,703,973, it is to be understood that such placement may cause difficulty in other vehicles, or may in fact be impossible to achieve, since such mid-space of the vehicle may by necessity be occupied by, for example, the operator's station thereof, the power source of the vehicle, etc.

SUMMARY OF THE INVENTION

It is accordingly an object of this invention to provide a vehicle which includes an implement which may be moved from an outward to an inward position relative to the vehicle upon loading of such implement, so that such load may be carried in an extremely stable position.

It is a further object of this invention to provide a vehicle which, while fulfilling the above object, is capable of moving the bucket from one side of the axis of rotation of a pair of wheels, such implement being loaded on such one side, to the other side of the axis of rotation of such associated pair of wheels for stable carrying thereof.

It is a still further object of this invention to provide a vehicle which, while fulfilling the above objects, includes means for insuring stable placement and carrying of such loaded bucket.

It is a still further object of this invention to provide a vehicle which, while fulfilling the above objects, is extremely simple in design and effective in use.

Broadly stated, the invention comprises a vehicle having frame means and a pair of wheels rotatable about a common axis relative to the frame means. Such invention comprises arm means pivotally mounted relative to the frame means to be pivotable substantially about the axis of rotation of the wheels. Further included are implement means, and linkage means interconnecting the arm means and implement means. The implement means are movable, through pivoting of the arm means and actuation of the linkage means, from a position generally on one side of the axis of rotation of the wheels to a position generally on the other side of the axis of rotation of the wheels. Means are included for selectively pivoting the arm means and actuating the linkage means.

BRIEF DESCRIPTION OF THE DRAWINGS

These and other objects of the invention will become apparent from a study of the following specification and drawings, in which.

DESCRIPTION OF THE PREFERRED EMBODIMENT

Figure 1:
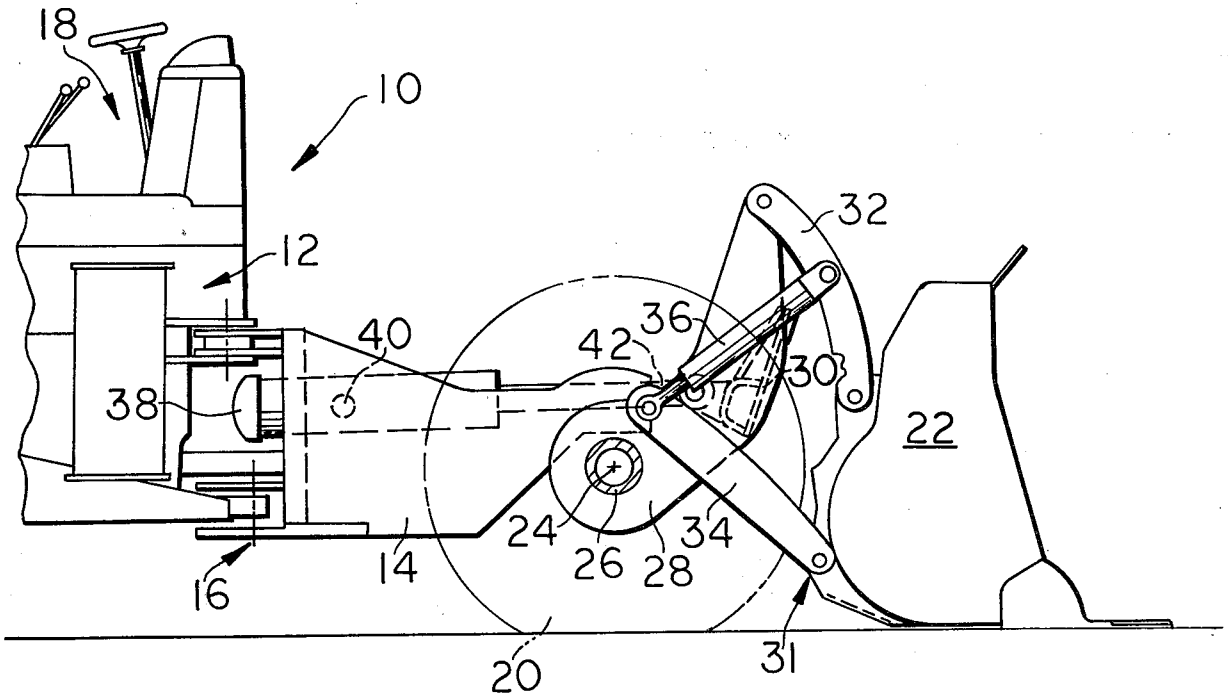
FIG. 1 is a partial side elevation of a wheel loader incorporating the present invention, wherein the bucket and means associated therewith are in a forward position.

As shown in FIG. 1, an articulately steered wheel loader 10 includes rearward and forward frame portions 12 and 14 that are coupled at their adjoining ends by vertically extending pivot means 16. Rearwardly disposed engine and control means indicated generally at 18 are provided to drive and control corner mounted traction wheels 20. The wheels 20 also afford power for loading a front-mounted bucket 22 through means which will be described in detail.

As shown in the drawings, the wheels 20 comprise the front wheels of the vehicle, which are rotatable about a common axis 24 relative to the frame 14. Such axis of rotation 24 of the front wheels 20 is defined by axle housings 26 mounted to the frame portion 14 and associated with the front wheels 20.

Figure 2:
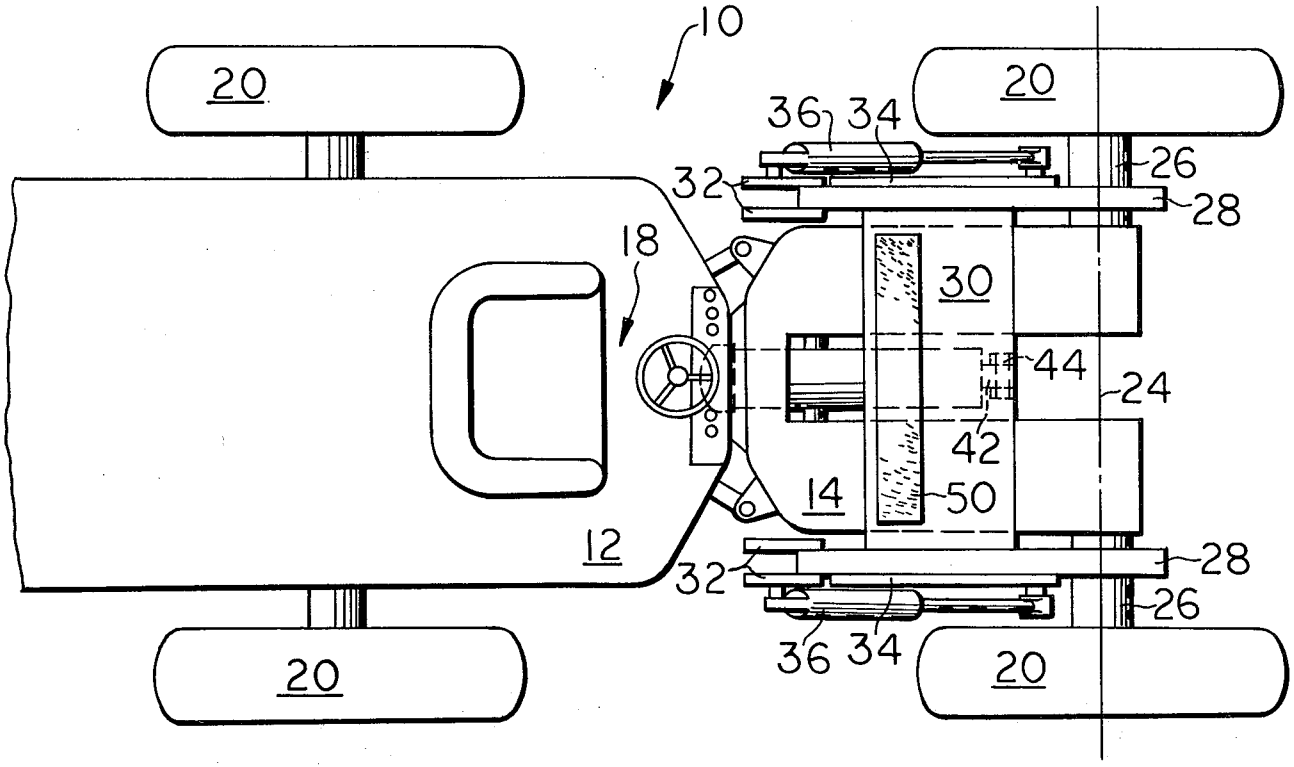
FIG. 2 is a plan view of the vehicle of FIG. 1, with the bucket removed, and with the means associated therewith in a retracted position.

As best shown in FIGS. 1 and 2, arms 28 are pivotally mounted on the outer ends of the axle housings 26, inwardly of the front wheels 20, and are interconnected in laterally spaced relation by an integrating cross-beam 30. It will thus be seen that the arms 28 are pivotally mounted relative to the frame portion 14 to be pivotable about the axis of rotation 24 of the wheels 20.

Pivotally connected to the arms 28 at the extended ends thereof are a pair of upper links 32. Pivotally connected to the arms 28 more adjacent the axle housings 26 are a pair of lower links 34. Such upper and lower links 32, 34 have their extended ends pivotally connected to the bucket 22, at the back portion thereof. The linkage means 31 made up of upper and lower links 32, 34, thus interconnect the arms 28 and the bucket 22.

A pair of hydraulic jacks 36 are included for actuating the linkage means 31. Each hydraulic jack has one end pivotally connected to a respective upper link 32 intermediate the ends thereof, and the other end pivotally connected to a respective arm 28, placed to be pivotable relative to that arm 28 about the pivot axis of a lower link 34 relative to the arm 28. The pivot axes of the hydraulic jacks 36 relative to the arms 28 are aligned, being disposed generally transversely of the vehicle 10.

It will be seen that retraction and extension of the jacks 36 moves the bucket 22 relative to the arms 28, actually pivoting such bucket 22 relatively forwardly and rearwardly. Through actuation of such linkage means 31, the bucket 22 may be tilted relatively forwardly and rearwardly of the vehicle 10, in one and the other directions.

A centrally disposed hydraulic jack 38 is pivotally supported by trunnions 40 fixed relative to the frame portion 14, adjacent the rearward end of such frame portion 14. The rod end 42 of such jack 38 is pivotally connected to the cross beam 30 by means of a pin 44, and thus is pivotally connected relative to the arms 28. The jack 38 is disposed generally horizontally relative to the vehicle 10, and may be selectively extended and retracted to pivot the arms 28 about the pivot axis 24 described above.

In operation, the vehicle 10 and its bucket 22 are manipulated to place the bucket 22 forwardly of the front wheels 20, generally on one side of the axis of rotation 24 of the wheels 20. The bucket 22 is manipulated until a cutting edge thereof penetrates sufficiently to assure a full load of material. A below-ground level cut is achieved by extending the jacks 36 to pivot bucket 22 and lower the cutting edge. Rackback is provided for most efficient loading by further retraction of the jacks 36.

Figure 3:
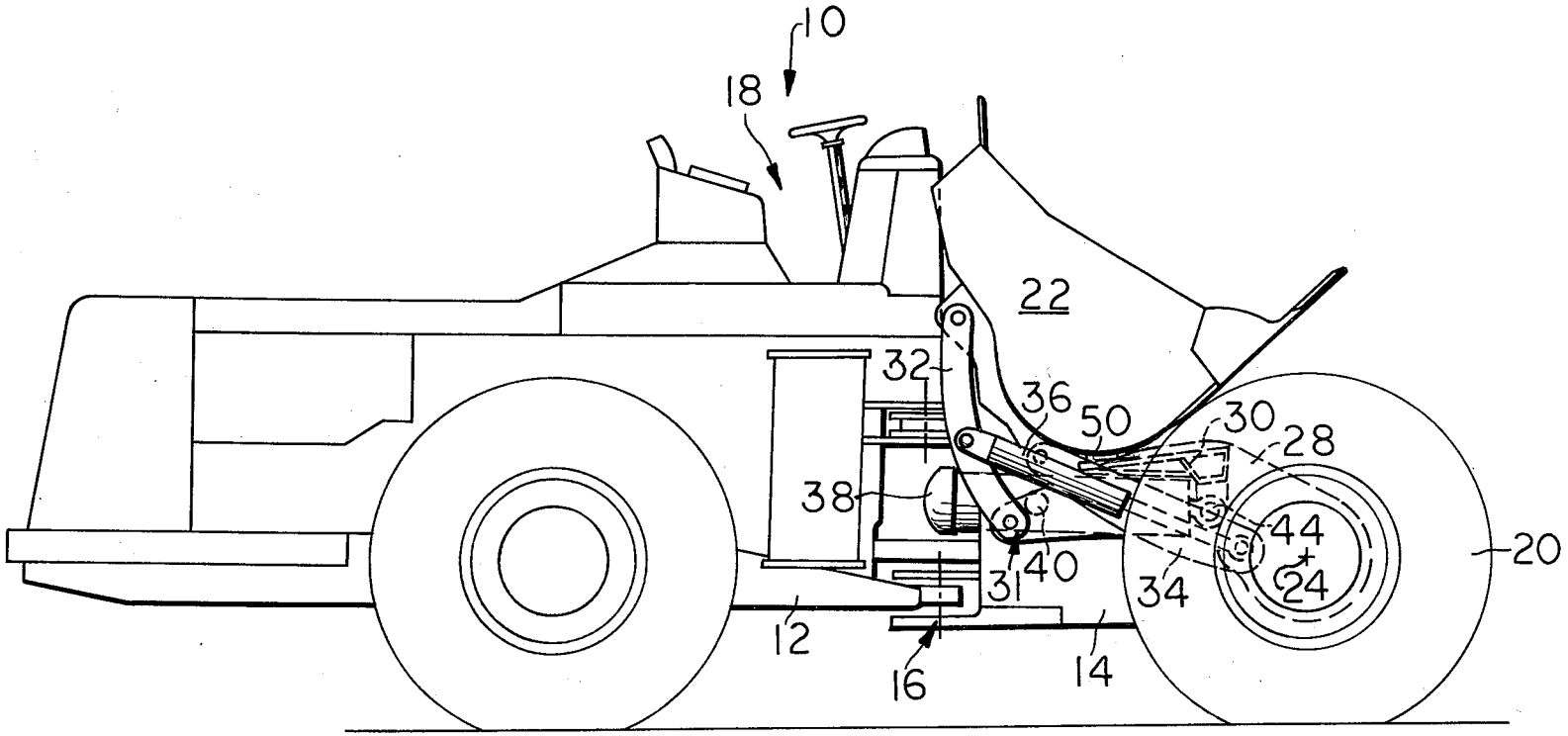
FIG. 3 is a side elevation of the wheel loader of FIGS. 1 and 2 with the bucket and means associated therewith in a retracted carry or transport position.

After the bucket 22 is filled, jack 38 is activated by manipulation of suitable controls (not shown) to retract the rod 42 thereof. In response (see FIG. 3) the arms 28 pivot upwardly and rearwardly about their pivot axis 24 until jack 38 is in a substantially completely collapsed state. As the arms 28 are being pivoted rearwardly, the jacks 36 are extended to cause the bucket 22 to be rotated downwardly, and the bucket 22 is moved to a position generally on the other side of the axis of rotation 24 of the wheels 20, generally rearwardly of the forward wheels 20 to be placed in a generally mid-vehicle position. The bucket 22 in this position is placed relatively rearwardly of the forward position previously described.

With the bucket 22 in such rearward position, such bucket 22 is supported by a resilient pad 50 fixed to the cross beam 30, which acts as effective stop means positioned to contact and support the bucket 22 with the bucket 22 in such rearward position.

It will thus be seen that the loaded bucket 22 is in a stable transport position, providing proper and efficient overall balance of the vehicle 10, meanwhile with the loaded bucket 22 being carried in an extremely safe and stable manner.

Dumping of the load from the bucket 22 is effected in a similar but reverse manner by the control circuit. At any forward position, the bucket may be tipped and dumped by full extension of the jacks 36.

What is claimed is:

1. In a vehicle having frame means and a pair of wheels rotatable about a common axis relative to said frame means;

arm means pivotally mounted relative to said frame means to be pivotable substantially about the axis of rotation of the wheels;

material carrying implement means;

linkage means interconnecting said arm means and material carrying implement means;

the material carrying implement means being movable, through pivoting of the arm means and actuation of the linkage means, from a position generally on one side of the axis of rotation of the wheels for loading thereof and carrying material therein to a position generally on the other side of the axis on the rotation of the wheels while carrying material therein;

means for supporting the material carrying implement means with material therein, positioned generally on the other side of the axis of rotation of the wheels, wherein the means for supporting the implement means comprises stop means mounted on said arm means, positioned to contact and support the implement means when said implement means is positioned generally on the other side of the axis of rotation of the wheels; and means for selectively pivoting said arm means and actuating said linkage means.

2. The apparatus of claim 1 wherein said linkage means comprise means for tilting the implement means relatively forwardly and rearwardly of the vehicle, upon actuation of said linkage means, in one and the other directions.

3. The apparatus of claim 2 wherein said linkage means comprise upper link means pivotally connected to the arm means and the implement means, and lower link means pivotally connected to the arm means and the implement means.

4. The apparatus of claim 3 wherein the means for actuating the linkage means comprise jack means pivotally interconnecting the arm means and upper link means, and pivotable relative to the arm means substantially about the pivot axis of the lower link means relative to the arm means.

5. The apparatus of claim 4 wherein the implement means comprise a bucket.

6. The apparatus of claim 1 wherein with said implement means positioned generally on the one side of the axis of rotation of said wheels, said implement means are positioned forwardly relative to the vehicle, and wherein, with said implement means positioned generally on said other side of the axis of rotation of said wheels, said implement means are positioned relatively rearwardly of said forward position thereof.

7. The apparatus of claim 1 wherein said stop means comprise resilient pad means.

8. The apparatus of claim 7 wherein the means for selectively pivoting the arm means comprise jack means disposed generally horizontally relative to the vehicle and pivotally mounted relative to the frame means and the arm means.

9. The apparatus of claim 8 wherein said implement means comprise a bucket.

10. The apparatus of claim 6 wherein said linkage means comprise means for tilting the implement means relatively forwardly and rearwardly of the vehicle, upon actuation of said linkage means, in one and the other directions.

11. The apparatus of claim 10 wherein said linkage means comprise upper link means pivotally connected to the arm means and the implement means, and lower link means pivotally connected to the arm means and the implement means.

12. The apparatus of claim 11 wherein the means for actuating the linkage means comprise jack means pivotally interconnecting the arm means and upper link means, and pivotable relative to the arm means substantially about the pivot axis of the lower link means relative to the arm means.

13. The apparatus of claim 12 wherein the implement means comprise a bucket.

* * * * *